US009209574B2

(12) United States Patent
Kuo

(10) Patent No.: US 9,209,574 B2
(45) Date of Patent: Dec. 8, 2015

(54) ELECTRICAL CONNECTOR

(71) Applicant: HON HAI PRECISION INDUSTRY CO., LTD., New Taipei (TW)

(72) Inventor: Pin-Han Kuo, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/483,105

(22) Filed: Sep. 10, 2014

(65) Prior Publication Data

US 2015/0072560 A1 Mar. 12, 2015

(30) Foreign Application Priority Data

Sep. 10, 2013 (TW) ..... 102216957 U

(51) Int. Cl.

| | |
|---|---|
| ***H01R 13/648*** | (2006.01) |
| ***H01R 13/6591*** | (2011.01) |
| *H01R 12/71* | (2011.01) |
| *H01R 13/6582* | (2011.01) |

(52) U.S. Cl.

CPC ..... *H01R 13/6591* (2013.01); *H01R 12/712* (2013.01); *H01R 13/6582* (2013.01)

(58) Field of Classification Search

CPC ..... H01R 13/65802; H01R 23/27

USPC ..... 439/607.17, 284, 259, 682, 591

See application file for complete search history.

(56) References Cited

U.S. PATENT DOCUMENTS

| | | | | |
|---|---|---|---|---|
| 7,104,843 | B2 * | 9/2006 | Olson et al. | 439/607.18 |
| 7,165,989 | B2 * | 1/2007 | Huang et al. | 439/346 |
| 7,575,454 | B1 * | 8/2009 | Aoki et al. | 439/188 |
| 7,798,832 | B2 * | 9/2010 | Qin et al. | 439/188 |
| 7,871,297 | B2 | 1/2011 | Li | |
| 2008/0248695 | A1 * | 10/2008 | Hu et al. | 439/620.22 |
| 2009/0061671 | A1 * | 3/2009 | Qin et al. | 439/188 |
| 2009/0098772 | A1 * | 4/2009 | Qin et al. | 439/595 |

* cited by examiner

*Primary Examiner* — Phuongchi T Nguyen

(74) *Attorney, Agent, or Firm* — Wei Te Chung; Ming Chieh Chang

(57) ABSTRACT

An electrical connector (100) includes an insulative housing (10), a plurality of contacts (20) mounted on the insulative housing, a first metal shell (30), a second metal shell (40), and an insulative member (44). The first metal shell includes a plurality of side walls (31) and a receiving room (32) formed by the side walls. One of the side walls includes a spring beam (310) extending forwardly. The second metal shell (40) is disposed at an outer side of the first metal shell. The second metal shell includes a body portion (41), a supporting beam (42) extending forwardly from the body portion and flanking the spring beam, and a cantilever portion (43) extending from the body portion and offsetting from the supporting beam. The insulative member is attached on the cantilever portion and spaced apart from the spring beam.

10 Claims, 10 Drawing Sheets

ELECTRICAL CONNECTOR

BACKGROUND OF THE INVENTION

1. Field of the Invention

The present invention relates to an electrical connector, and more particularly to an electrical connector adapted for being mounted on a metal shell of an electrical device.

2. Description of Related Arts

U.S. Pat. No. 7,871,297, issued on Jan. 18, 2011 to Li, discloses an electrical connector adapted for being mounted on an opening of a shell of an electrical device. The electrical connector comprises an insulative housing, a plurality of contacts mounted on the insulative housing, and a metal shell enclosing the insulative housing. The metal shell defines a receiving room for receiving a plug connector. The metal shell comprises, on each of a top wall and a bottom wall thereof, a pair of flexible plates or spring beams each having a portion extending into the receiving room. When the plug connector is plugged into the electrical connector, the spring beams may be so pushed outwardly as to touch the electrical device shell and therefore cause interference signal. In addition, the spring beams may not provide sufficient mating force.

An improved electrical connector is desired to offer advantages over the related art.

SUMMARY OF THE INVENTION

An object of the present invention is to provide an electrical connector that could prevent the spring beam of the electrical connector from touching with a shell of an electrical device, and having enhanced mating force.

To achieve the above-mentioned object, an electrical connector adapted for being mounted on an opening defined on a metal shell of an electrical device comprises an insulative housing, a plurality of contacts mounted on the insulative housing, a first metal shell, a second metal shell, and an insulative member. The first metal shell comprises a plurality of side walls and a receiving room formed by the side walls. The insulative housing is received in the receiving room. One of the side walls comprises a spring beam extending forwardly. The second metal shell is disposed at an outer side of the first metal shell. The second metal shell comprises a body portion, a supporting beam extending forwardly from the body portion and flanking the spring beam, and a cantilever portion extending from the body portion and offsetting with respect to the supporting beam. The insulative member is attached on the cantilever portion and spaced apart from the spring beam to prevent the spring beam from touching the metal shell of the electrical device.

According to the present invention, the electrical connector comprises a second metal disposed at an outer side of the first metal shell, and an insulative member attached on the second metal to prevent the spring beam from touching with an outer shell of the electrical device. The second metal shell comprises a supporting beam extending forwardly and flanking the spring beam to enhance the spring beam.

DETAILED DESCRIPTION OF THE PREFERRED EMBODIMENT

Figure 1:
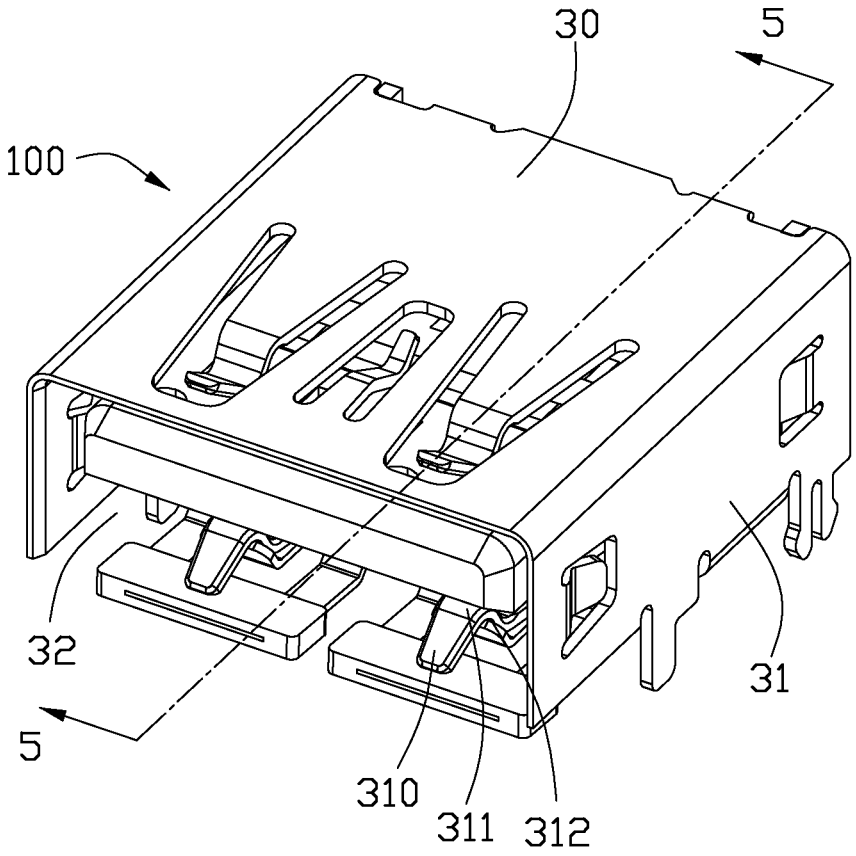
FIG. 1 is a perspective view of a first embodiment of an electrical connector in accordance with the present invention.
Figure 2:
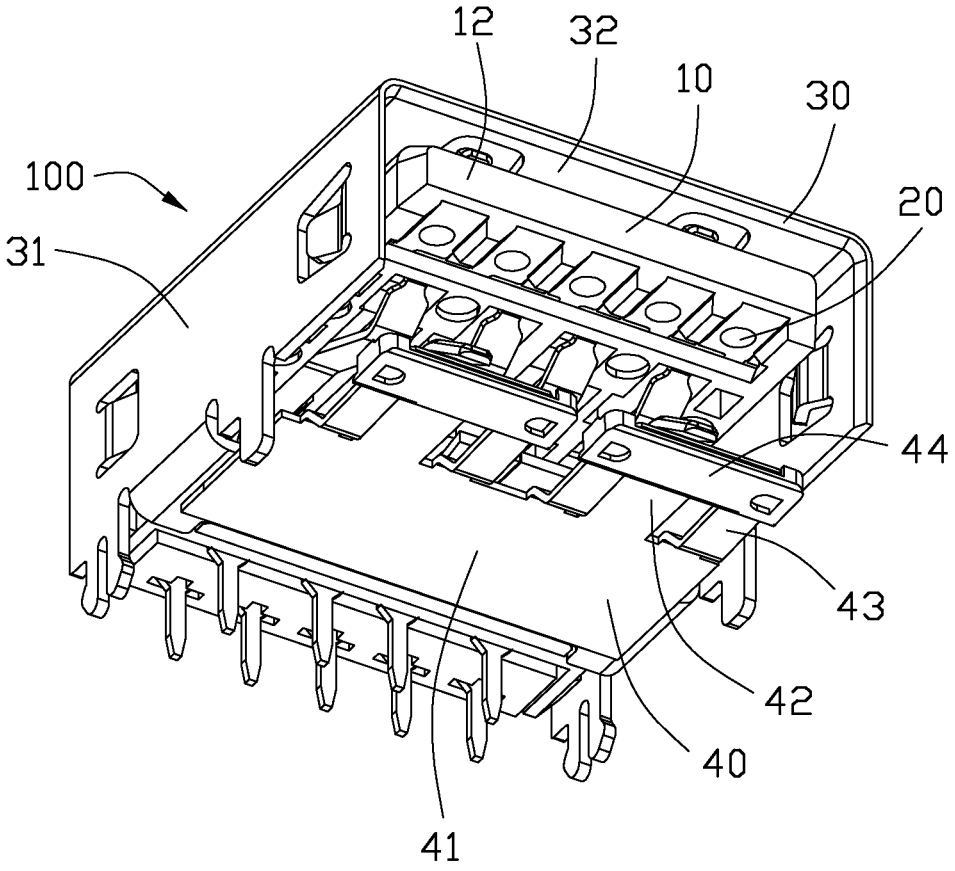
FIG. 2 is another perspective view the electrical connector as shown in FIG. 1.
Figure 3:
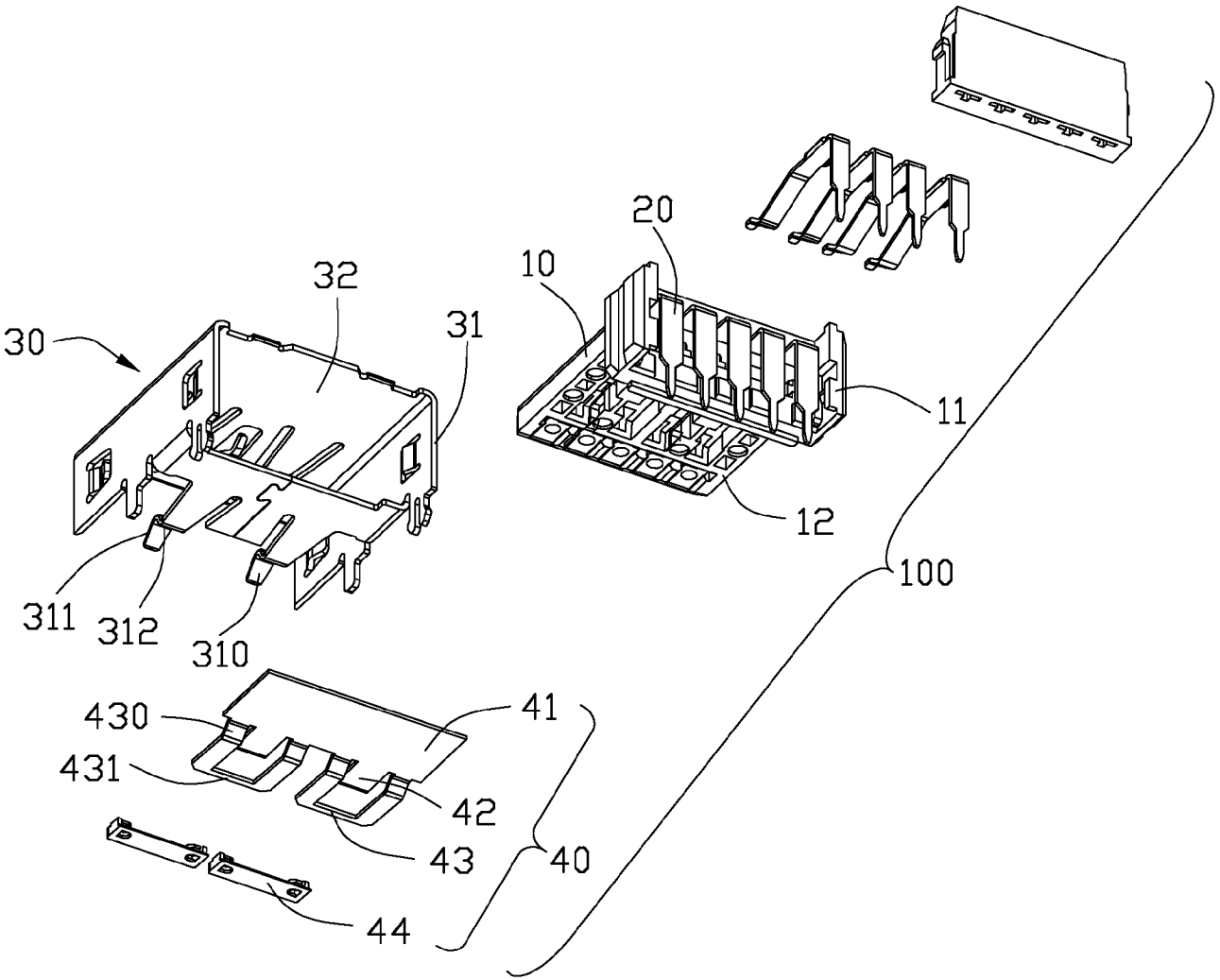
FIG. 3 is an exploded view of the electrical connector as shown in FIG. 1.
Figure 4:
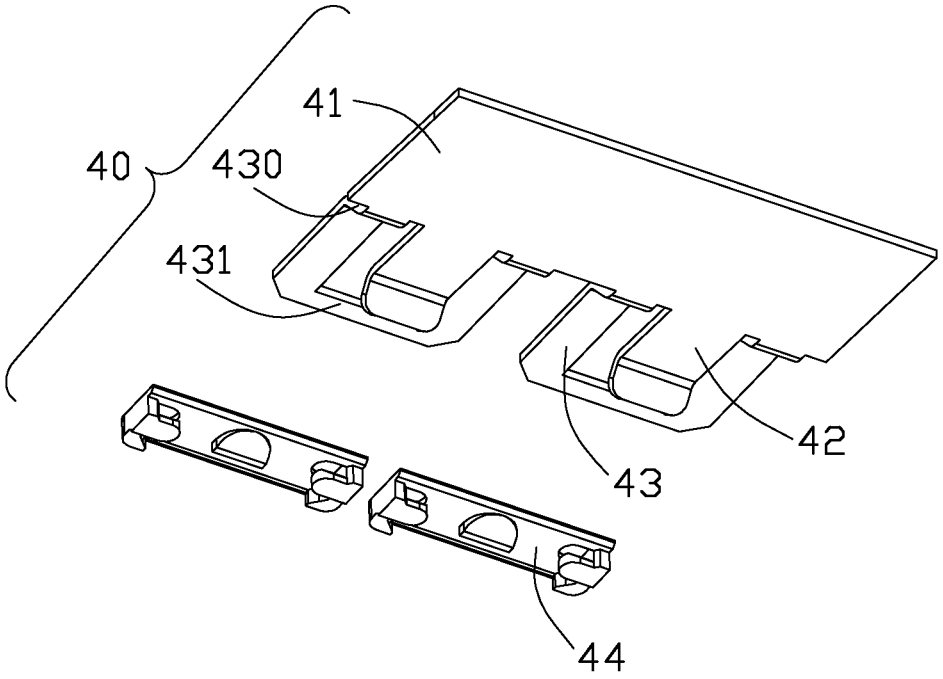
FIG. 4 is an exploded view of the second metal shell and the insulative member of the electrical connector as shown in FIG. 1.
Figure 5:
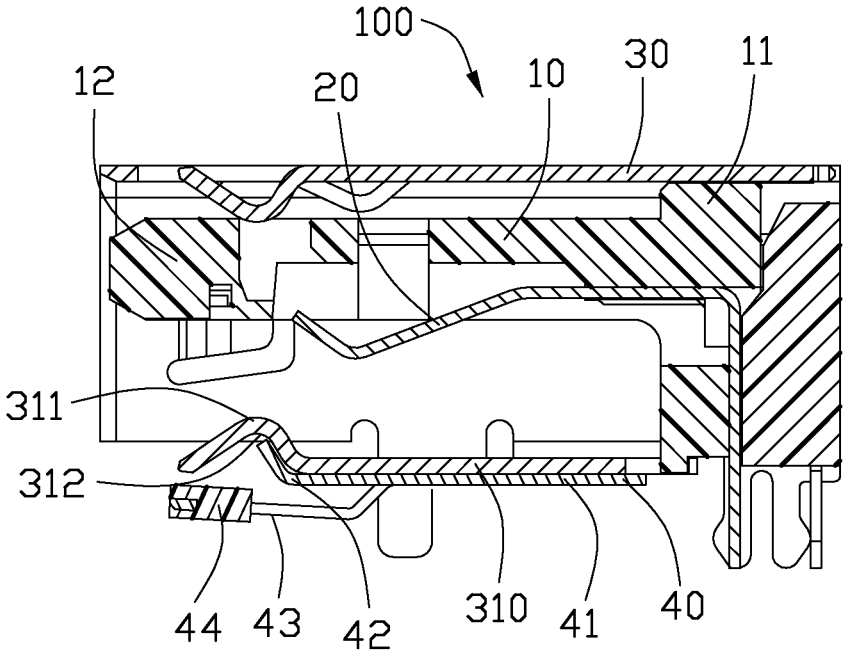
FIG. 5 is a cross-sectional view of the electrical connector taken along line 5-5 of FIG. 1.
Figure 6:
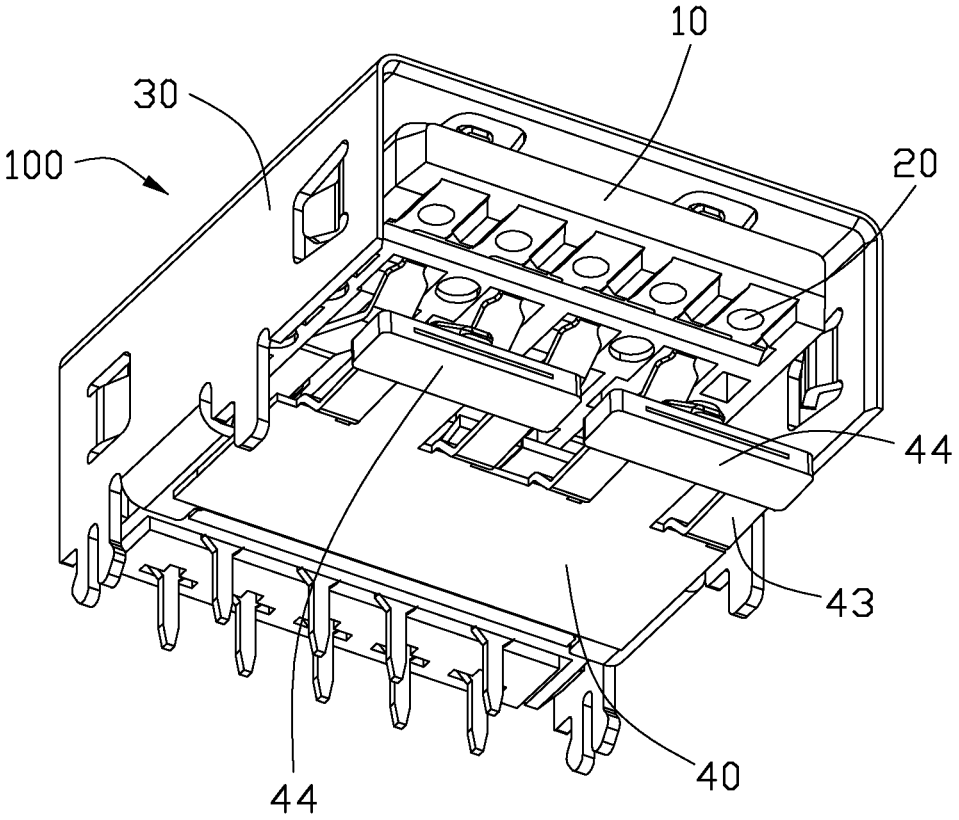
FIG. 6 is a perspective view of a second embodiment of an electrical connector in accordance with the present invention.
Figure 7:
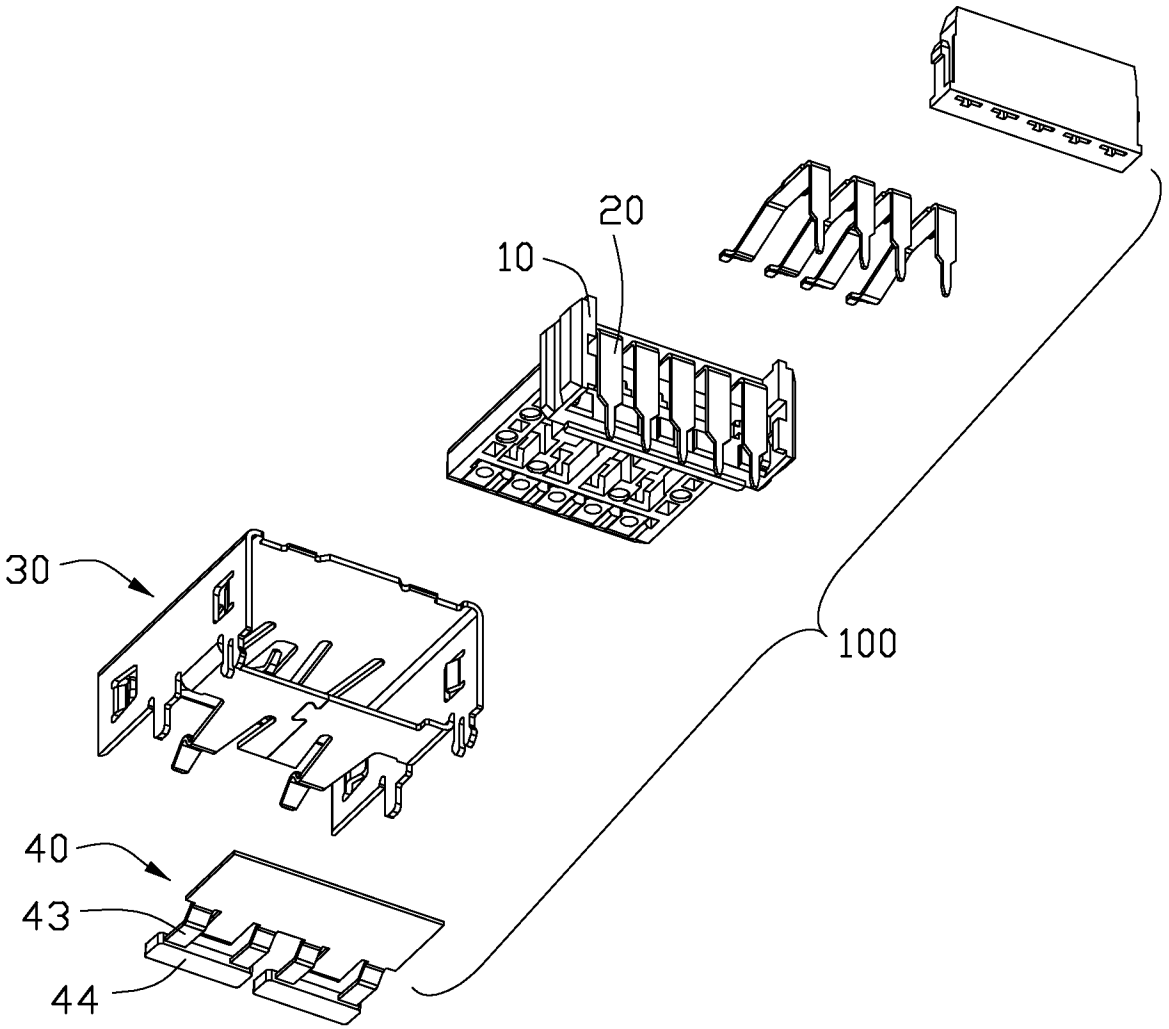
FIG. 7 is an exploded view the electrical connector as shown in FIG. 6.
Figure 8:
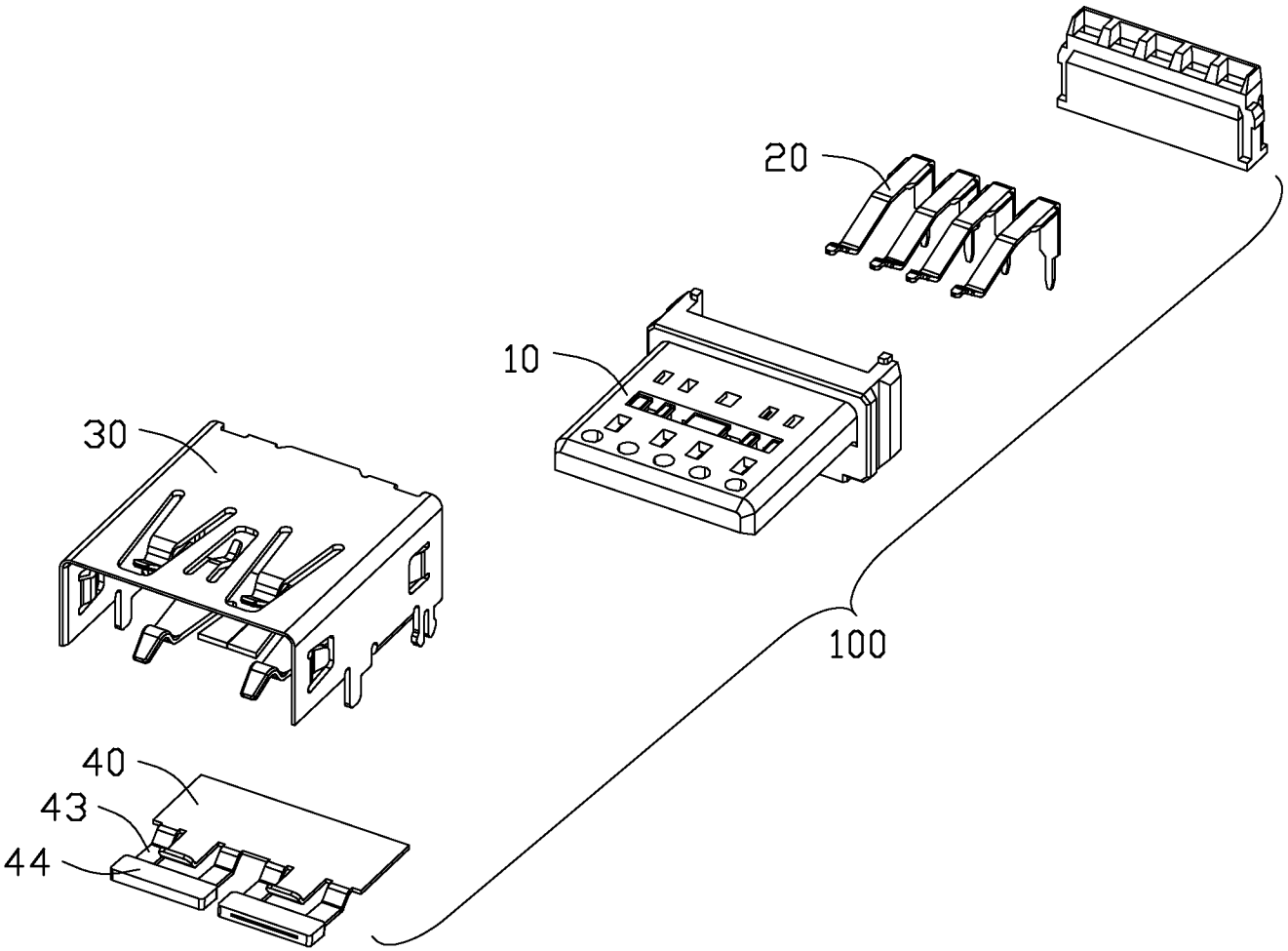
FIG. 8 is another exploded view the electrical connector as shown in FIG. 7.

Reference will now be made in detail to a preferred embodiment of the present invention.

Referring to FIGS. 1 to 5, a first embodiment of an electrical connector 100 in accordance with the present invention, adapted for being mounted on an opening of a metal shell of an electrical device (not shown) and for mating with a plug connector, comprises an insulative housing 10, a plurality of contacts 20 mounted on the insulative housing 10, a first metal shell 30 mounted on the insulative housing 10, a second metal shell 40 disposed at an outer side of the first metal shell 30, and a pair of insulative members 44.

The insulative housing 10 comprises a base portion 11 and a tongue portion 12 extending forwardly from the base portion 11. The contacts 20 are assembled to the insulative housing 10, or molding with the insulative housing 10, or some of contacts 20 assembled with the insulative housing 10 and the others molding with the insulative housing 10.

The first metal shell 30 comprises a four side walls 31 and a receiving room 32 formed by the four side walls 31. The insulative housing is received in the receiving room 32. The first metal shell has a rectangle shape. The first metal shell 30 is latched with the insulative housing 10. The plug connector could plug into the receiving room to electrically connecting with the contacts 20. One of the side walls which is disposed at a bottom of the first metal shell 30 comprises a pair of spring beams 310 spaced apart from each other and extending forwardly. Each of the spring beams 310 comprises a curved portion 311 adjacent to a free end of the spring beam 310 and extending into the receiving room 32, and a hollow portion 312 formed on an opposite side of the curved portion 311.

The second metal shell 40 comprises a body portion 41, a pair of supporting beams 42 extending forwardly from the body portion 41 and into the hollow portion 312 to flank the spring beams 310 to enhance the spring force of the spring beams 310, and a pair of cantilever portions 43 extending from the body portion 41 offset with the supporting beams 42. The insulative members 44 are attached on the cantilever portions 43, respectively, and spaced apart from the spring beams 310 to prevent the spring beams 310 from touching with the metal shell of the electrical device. The second metal shell 40 and the first metal shell 30 are connected by laser soldering or latching. Each cantilever portion 43 and corresponding one supporting beam 42 are separated by punched a metal sheet. Each of the cantilever portions 43 comprises a pair of extending beams 430 extending form the body portion 41 and spaced apart from each other, and a connecting beam 431 connecting with free ends of the extending beams 430. The insulative members 44 are mounted on the cantilever portions 43, respectively.

Referring to FIGS. 1 to 5, a second embodiment of an electrical connector 100 in accordance with the present invention comprises an insulative housing 10, a plurality of contacts 20 mounted on the insulative housing 10, a first metal shell 30 mounted on the insulative housing 10, and a second metal shell 40 disposed at an outer side of the first metal shell 30. The difference between the second and the first embodiments is the insulative members 44 molding with the cantilever portions 43.

Figure 9:
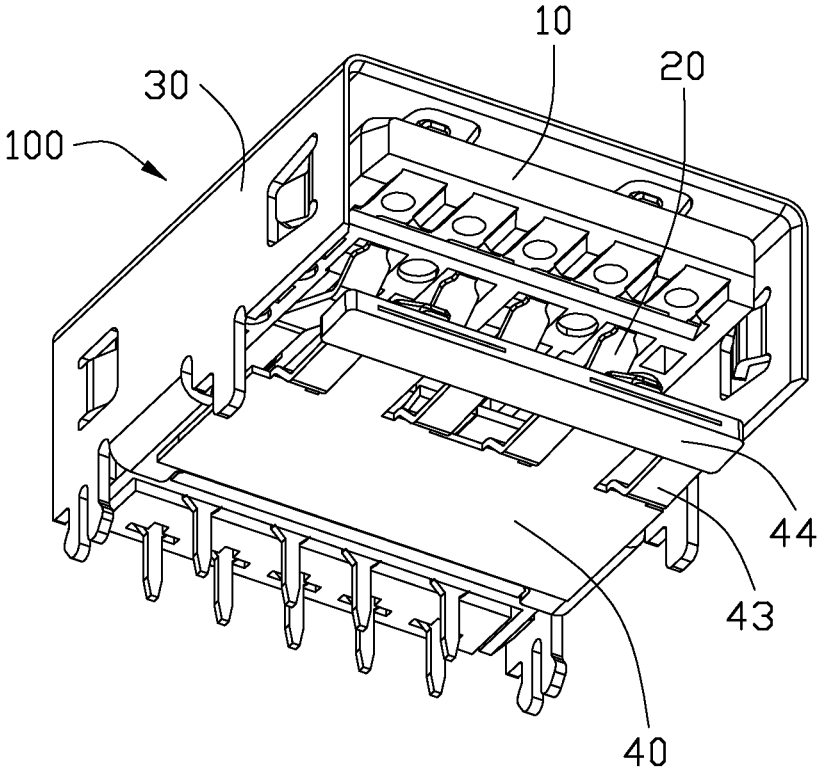
FIG. 9 is a perspective view of a third embodiment of an electrical connector in accordance with the present invention.
Figure 10:
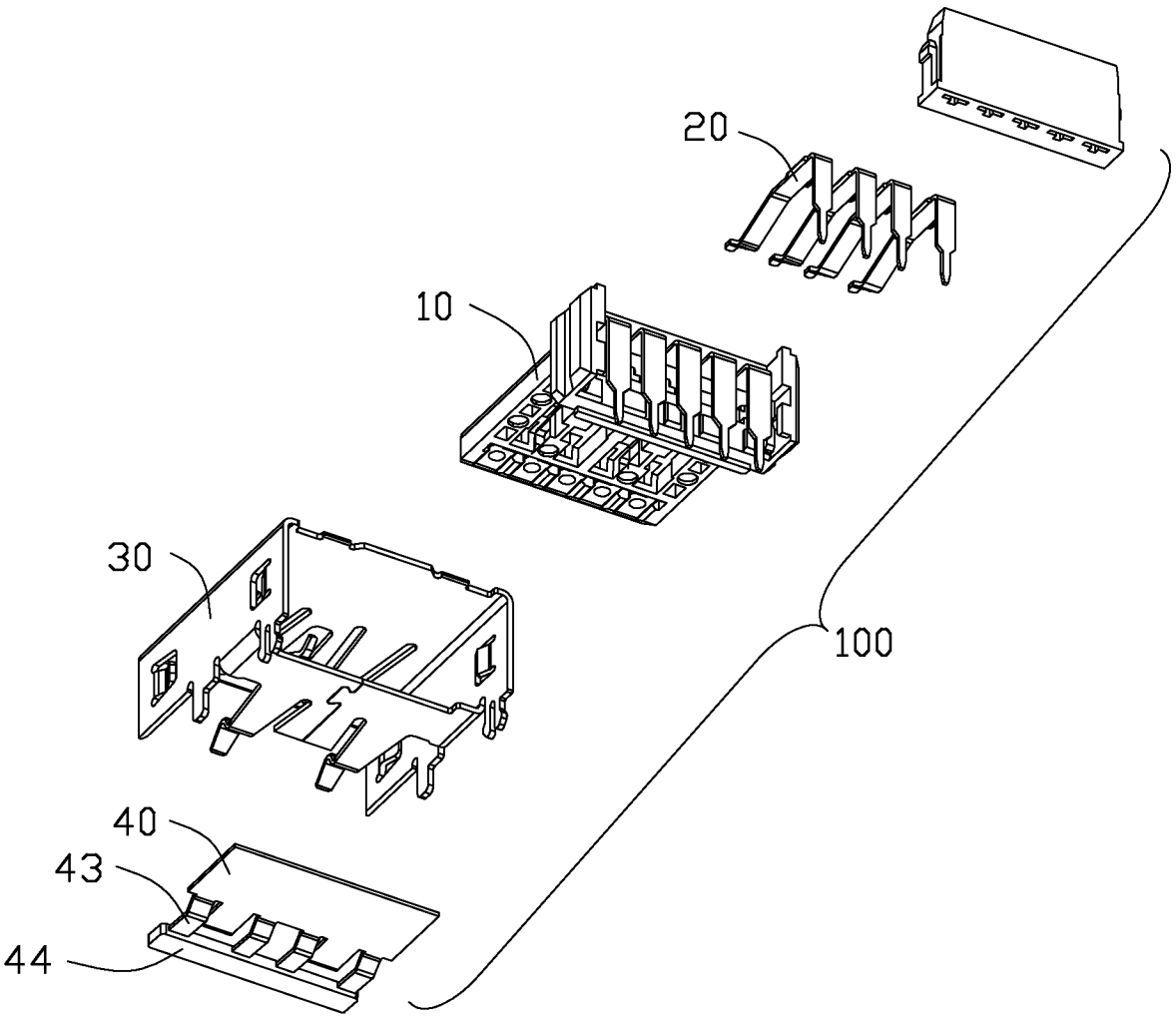
FIG. 10 is an exploded view the electrical connector as shown in FIG. 9.

Referring to FIGS. 9 and 10, a third embodiment of an electrical connector 100 in accordance with the present invention comprises an insulative housing 10, a plurality of contacts 20 mounted on the insulative housing 10, a first metal shell 30 mounted on the insulative housing 10, a second metal shell 40 disposed at an outer side of the first metal shell 30. The difference between the second and the second embodiments is one insulative member 44 molding with the two cantilever portions 43.

It is to be understood, however, that even though numerous characteristics and advanarmes of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for being mounted on an opening defined on a metal shell of an electrical device, comprising:

an insulative housing;

a plurality of contacts mounted on the insulative housing;

a first metal shell comprising a plurality of side walls and a receiving room formed by the side walls, the insulative housing received in the receiving room, one of the side walls comprising a spring beam extending forwardly;

a second metal shell disposed at an outer side of the first metal shell, the second metal shell comprising a body portion, a supporting beam extending forwardly from the body portion and flanking the spring beam, and a cantilever portion extending from the body portion and offsetting with respect to the supporting beam; and an insulative member attached on the cantilever portion and spaced apart from the spring beam to prevent the spring beam from touching the metal shell of the electrical device; wherein there are a pair of spring beams and a pair of supporting beams corresponding to the spring beams; wherein there are a pair of cantilever portions, each cantilever portion and a corresponding supporting beam being separated by punching a metal sheet; wherein there are a plurality of insulative members spaced apart from each other and mounted on the cantilever portions, respectively; wherein the second metal shell and the first metal shell are connected by laser welding or latching; wherein the spring beam comprises a curved portion adjacent to a free end of the spring beam and extending into the receiving room, and a hollow portion formed on an opposite side of the curved portion, a free end of the supporting beam extending into the hollow portion.

2. The electrical connector as recited in claim 1, wherein there are a plurality of insulative members spaced apart from each other and molded with the cantilever portions, respectively.

3. The electrical connector as recited in claim 1, wherein the insulative member is molded with the pair of the cantilever portions.

4. The electrical connector as recited in claim 1, wherein each of the cantilever portions comprises a pair of extending beams extending from the body portion and spaced apart from each other, and a connecting beam connecting with free ends of the extending beams.

5. The electrical connector as recited in claim 1, wherein the first metal shell is latched with the insulative housing.

6. An electrical connector for mounting to a printed circuit board, comprising:

an insulative housing;

a metallic shell attached to and enclosing the housing, said shell including opposite top and bottom walls and opposite lateral side walls to commonly define a receiving space;

a plurality of contacts disposed in the housing with contacting sections exposed in the receiving space;

at least one spring beam unitarily formed on the bottom wall of the shell in a cantilever manner via a stamping process, said spring beam including a contacting apex extending into the receiving space and a downward tip section in front of the contacting apex;

a pair of mounting legs unitarily extending downwardly from the shell beyond the bottom wall, each of said mounting legs including a standoff structure to have the bottom wall spaced from the printed circuit board when the connector is mounted upon the printed circuit board; and a metallic device attached to the shell and including an up-and-down deflectable portion with thereon an insulative member located under said tip section; wherein when the spring beam is downwardly deflected by an inserted complementary connector, downward movement of the tip section is efficiently spaced from the printed circuit board by said insulative member, wherein the up-and-down deflectable portion is a cantilevered portion; wherein said metallic device includes a horizontal body portion intimately attached to an underside of the bottom wall, and the cantilevered portion extends from a front edge of the body portion; wherein said cantilevered portion includes an offset section to lower the insulative member which is attached on a front end of the cantilevered portion; wherein a front edge of the bottom wall is rearwardly offset from that of the top wall so as not to interfere with the insulative member; wherein the metallic device and the metallic shell are connected by laser welding or latching.

7. The electrical connector as claimed in claim 6, wherein said tip section directly downwardly confronts the insulative member.

8. An electrical connector for mounting to a printed circuit board, comprising:

an insulative housing;

a metallic shell attached to and enclosing the housing, said shell including opposite top and bottom walls and opposite lateral side walls to commonly define a receiving space;

a plurality of contacts disposed in the housing with contacting sections exposed in the receiving space;

at least one spring beam unitarily formed on the bottom wall of the shell in a cantilevered manner via a stamping process, said spring beam including a contacting apex extending into the receiving space and a downward tip section in front of the contacting apex;

a pair of mounting legs unitarily extending downwardly from the shell beyond the bottom wall, each of said mounting legs including a standoff structure to have the bottom wall spaced from the printed circuit board when the connector is mounted upon the printed circuit board; and a metallic device attached to the shell and including an up-and-down supporting beam; wherein said supporting beam is discrete from while aligned with the spring beam and intimately contacting with an underside of the spring beam so as to form a click sense for an user when said spring arm is downwardly deflected by an inserted complementary connector; wherein said metallic device further includes a cantilevered portion with an insulative member attached at a front end thereof, and the insulative member is located under the tip sect; wherein the metallic device and the metallic shell are connected by laser welding or latching.

9. The electrical connector as claimed in claim 8, wherein said supporting beam is cantilevered.

10. The electrical connector as claimed in claim 9, wherein a front tip of the supporting beam is upwardly contacted with an underside of the contacting apex of the spring beam.

* * * * *